US009653827B2

(12) United States Patent
Li et al.

(10) Patent No.: US 9,653,827 B2
(45) Date of Patent: May 16, 2017

(54) BATTERY CONNECTOR WITH LARGE CURRENT CARRYING CAPACITY

(71) Applicant: Cheng Uei Precision Industry Co., Ltd., New Taipei (TW)

(72) Inventors: Qing-Liang Li, Dong-Guan (CN); Jui-Ming Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/846,696

(22) Filed: Sep. 4, 2015

(65) Prior Publication Data

US 2017/0069987 A1 Mar. 9, 2017

(51) Int. Cl.
*H01R 24/00* (2011.01)
*H01R 12/70* (2011.01)
*H01R 4/02* (2006.01)

(52) U.S. Cl.
CPC ..... *H01R 12/7076* (2013.01); *H01R 4/02* (2013.01)

(58) Field of Classification Search
CPC ..... H01R 12/7076; H01R 11/282; H01R 13/2421; H01R 13/725
USPC ..... 439/78, 700, 289, 607.55, 627
See application file for complete search history.

(56) References Cited

U.S. PATENT DOCUMENTS 4,773,877 A * 9/1988 Kruger ..... G01R 1/06722 324/755.05
5,967,856 A * 10/1999 Meller ..... H01R 13/2428 439/700
6,077,130 A * 6/2000 Hughes ..... H01R 13/2442 439/65
6,083,059 A * 7/2000 Kuan ..... H01R 13/2428 439/482
6,113,440 A * 9/2000 Fijten ..... H01R 13/2442 439/862
6,447,338 B1 * 9/2002 Bricaud ..... G06K 7/0021 439/630
6,572,386 B1 * 6/2003 Howell ..... H01R 13/2428 439/66
6,875,049 B2 * 4/2005 Kyowski ..... H01R 11/282 439/500

(Continued)

FOREIGN PATENT DOCUMENTS

JP 2013062060 A * 4/2013
JP 201526502 * 5/2015 ..... H01R 24/00

*Primary Examiner* — Tulsidas C Patel
*Assistant Examiner* — Peter G Leigh
(74) *Attorney, Agent, or Firm* — Cheng-Ju Chiang

(57) ABSTRACT

A battery connector includes an insulating body, a plurality of electrical terminals and a plurality of conducting pieces. The insulating body defines a plurality of terminal grooves penetrating through a front and a rear thereof and a plurality of inserting grooves communicating with the respective terminal grooves. The electrical terminals are assembled into the terminal grooves of the insulting body. The conducting pieces are assembled into the inserting grooves of the insulating body and contact with the electrical terminals. When the battery connector electrically connects the battery and the circuit board, part of the current passes through the conducting pieces, therefore heat generated by the electrical terminals is reduced to ensure that the temperature of the battery connector is within the normal range.

8 Claims, 5 Drawing Sheets

(56) References Cited

U.S. PATENT DOCUMENTS 6,951,488 B2 * 10/2005 Hsieh ..... H01R 12/7011 439/500
6,994,566 B2 * 2/2006 You ..... H01R 13/2442 439/66
7,077,709 B1 * 7/2006 Shin-Ting ..... H01R 13/2421 439/289
7,258,571 B1 * 8/2007 Chen ..... H01R 13/2442 439/289
7,527,532 B2 * 5/2009 Northey ..... H01R 13/2428 439/700
7,575,469 B1 * 8/2009 Hung ..... H01R 12/707 439/500
7,803,011 B1 * 9/2010 Mai ..... H01R 13/2428 439/500
7,942,677 B2 * 5/2011 Rikimaru ..... G01R 1/06722 439/66
8,079,875 B2 * 12/2011 Ho ..... H01R 23/6873 439/627
8,092,236 B2 * 1/2012 Yang ..... H01R 12/7052 439/500
8,192,217 B2 * 6/2012 Zhu ..... H01R 12/716 439/284
8,192,236 B1 * 6/2012 Zhu ..... H01R 12/724 439/627
8,303,353 B2 * 11/2012 Zhu ..... H01R 12/707 439/862
8,353,730 B1 * 1/2013 Wang ..... H01R 13/2421 439/515
8,491,338 B1 * 7/2013 Lin ..... H01R 13/2421 439/500
8,784,145 B2 * 7/2014 Koyama ..... H01R 13/2464 439/500
8,974,248 B2 * 3/2015 Lan ..... H01R 13/405 439/607.01
2005/0042938 A1 * 2/2005 Zheng ..... H01R 13/2421 439/824
2005/0054242 A1 * 3/2005 Hsieh ..... H01R 12/7011 439/660
2010/0120291 A1 * 5/2010 Hu ..... H01R 13/2442 439/627
2011/0151720 A1 * 6/2011 Xie ..... H01R 12/57 439/626
2011/0177725 A1 * 7/2011 Koyama ..... H01R 13/2428 439/759
2014/0287623 A1 * 9/2014 Lan ..... H01R 13/405 439/607.01
2015/0111434 A1 * 4/2015 Tagawa ..... H01R 12/716 439/626

* cited by examiner

BATTERY CONNECTOR WITH LARGE CURRENT CARRYING CAPACITY

BACKGROUND OF THE INVENTION

1. Field of the Invention

The present invention relates to a connector, and more particularly to a battery connector.

2. The Related Art

Electronic products are widely used. With the rapid development of electronic technology, the development direction of the electronic products is versatility and intellectualization. In order to achieve intellectualization, electronic products not only require continuous innovation in the application software, but also require being equipped with high-capacity battery to support the use of the electronic products. So, more and more electronic products use high-capacity battery to meet the demand of consumers. Meantime, a current smart electronic product is used to perform many functions, so the power of a battery of the smart electronic product can be used up rapidly.

The smart electronic product includes a circuit board and battery connector for connecting the battery and the circuit board. When the smart electronic product performs some functions, a current through terminals of the battery connector is large to make the terminals generate a lot of heat, and then the use life of the smart electronic product will be affected. Therefore, it's necessary to provide a battery connector which can transmit a large current and ensure the temperature of the battery connector and the smart electronic products being within the normal range.

SUMMARY OF THE INVENTION

An object of the present invention is to provide a battery connector. The battery connector includes an insulating body, a plurality of electrical terminals and a plurality of conducting pieces. The insulating body defines a plurality of terminal grooves penetrating through a front and a rear thereof and a plurality of inserting grooves communicating with the respective terminal grooves. The electrical terminals are assembled into the terminal grooves of the insulting body. The conducting pieces are assembled into the inserting grooves of the insulating body and contact with the electrical terminals.

As described above, the conducting pieces contact with the electrical terminals. When the battery connector electrically connects the battery and the circuit board, part of the current passes through the conducting pieces, therefore heat generated by the electrical terminals is reduced to ensure that the temperature of the battery connector is within the normal range.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
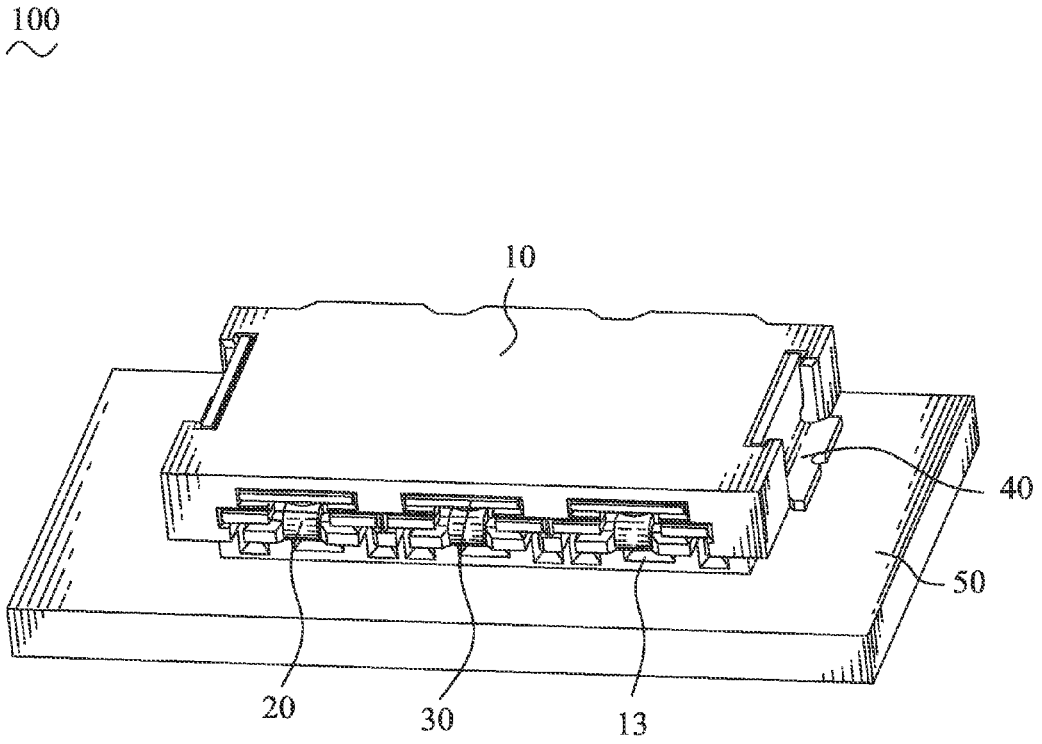
FIG. 1 is an assembled, perspective view of a combination of a battery connector and a circuit board in accordance with an embodiment of the present invention.
Figure 2:
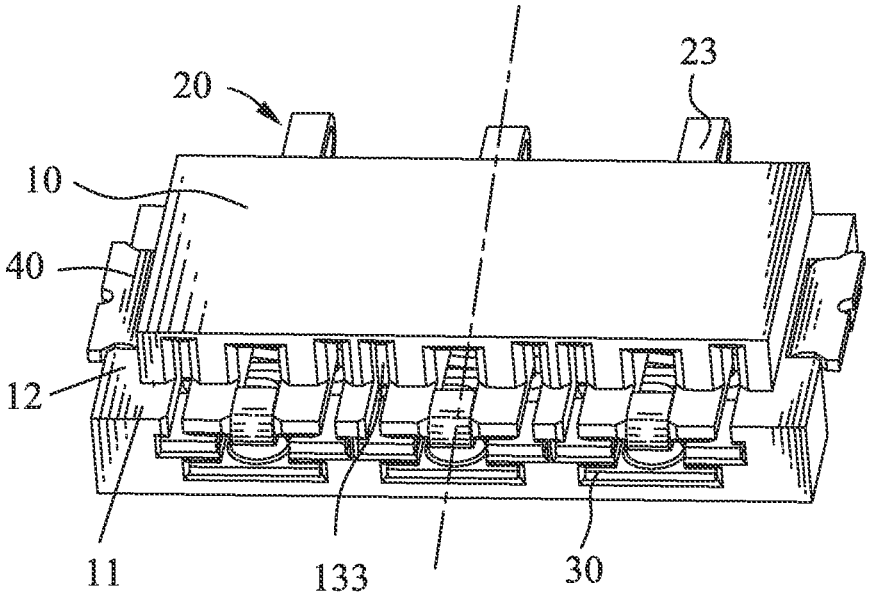
FIG. 2 is a perspective view of the battery connector shown in FIG. 1.

Referring to FIG. 1 and FIG. 2, a battery connector 100 according to an embodiment of the present invention includes an insulating body 10, a plurality of electrical terminals 20, a plurality of conducting pieces 30 and a plurality of fastening terminals 40. The battery connector 100 is assembled in a mobile phone for connecting an internal battery of the mobile phone to a circuit board 50.

Figure 3:
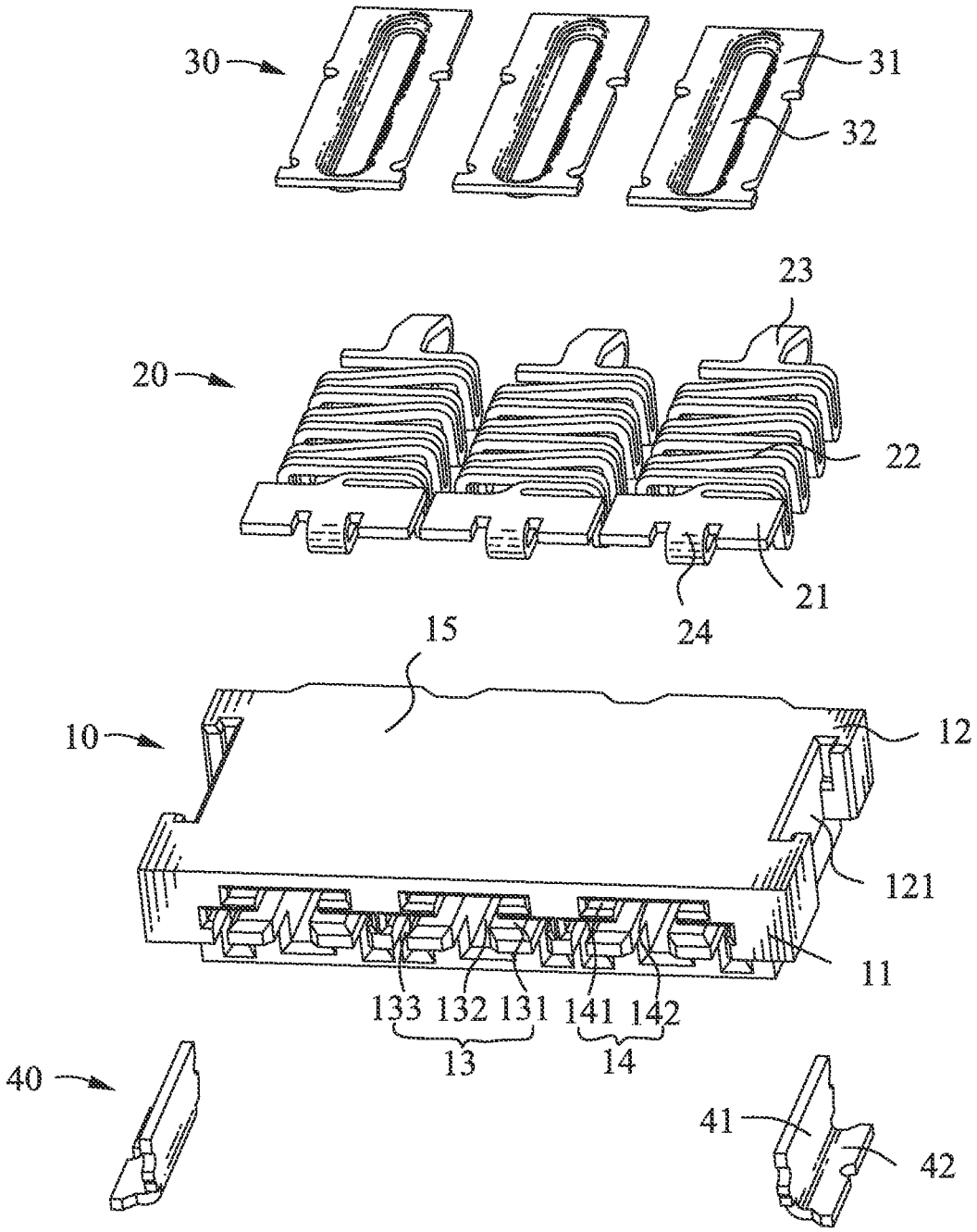
FIG. 3 is an exploded, perspective view of the battery connector shown in FIG. 1.
Figure 5:
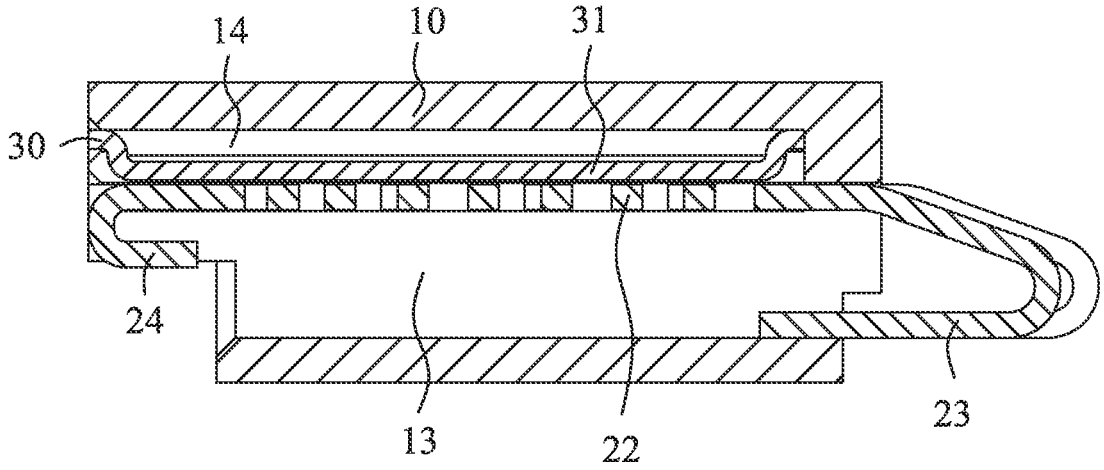
FIG. 5 is a sectional perspective view of the battery connector shown in FIG. 2.

Referring to FIG. 2, FIG. 3 and FIG. 5, the insulating body 10 has a substantially rectangular base body 15. An upper portion of a rear face of the base body 15 protrudes rearward to form a soldering table 11. Upper portions of two opposite sides of the base body 15 protrude outward to form two fixing tables 12 connecting with the soldering table 11. The insulating body 10 defines a plurality of terminal grooves 13 penetrating through a front and a rear thereof and a plurality of inserting grooves 14 communicating with the respective terminal grooves 13. Each of the inserting grooves 14 penetrates through the rear of the insulating body 10. Each of the terminal grooves 13 includes a flat receiving groove 131 penetrating through the rear of the insulating body 10. A middle of a bottom of the receiving groove 131 defines a through groove 132 penetrating through the front and the rear of the insulating body 10. Two side edges of the bottom of the receiving groove 131 define two side grooves 133 penetrating through the rear of the insulating body 10. The inserting grooves 14 are disposed over the respective terminal grooves 13. Each of the inserting grooves 14 shows a substantially "凸" shape and includes a wide groove 141 and a narrow groove 142. The narrow groove 142 communicates with the corresponding receiving groove 131. The inserting groove 14, the receiving groove 131, the through groove 132 and the side grooves 133 penetrate through the soldering table 11. A fastening groove 121 is opened in the fixing table 12 of the insulating body 10.

Figure 4:
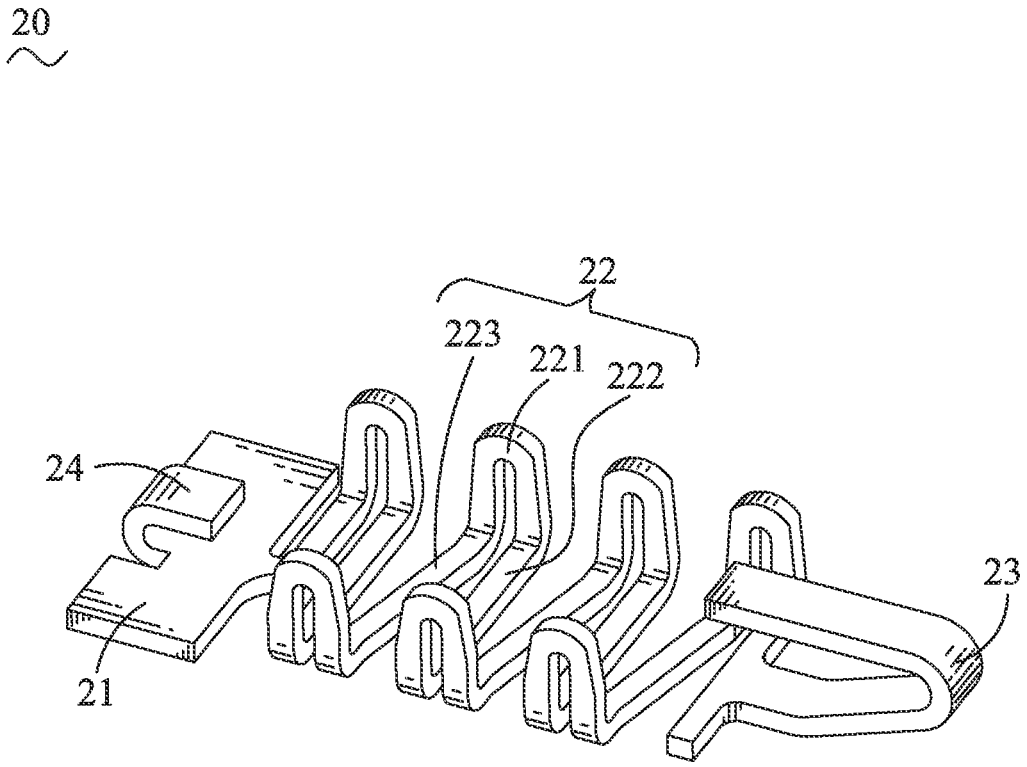
FIG. 4 is a perspective view of an electrical terminal of the battery connector shown in FIG. 1.

Referring to FIG. 2-4, the electrical terminals 20 may be assembled into the terminal grooves 13 of the insulting body 10 or other types of battery connector. The electrical terminals 20 are formed by punching a metal plate and then are bent. Each of the electrical terminals 20 has a holding portion 21, an elastic portion 22 which is connected with one end of the holding portion 21, a contact portion 23 which is connected with a distal end of the elastic portion 22, and a soldering portion 24 which is connected with the other end of the holding portion 21. The holding portion 21 is of plate shape. The elastic portion 22 is repeatedly folded along the right-left direction and extends in a longitudinal direction, the elastic portion 22 includes a plurality of U-shaped folded parts 221 formed in two rows in two sides thereof, a plurality of transverse connecting arms 222 and a plurality of oblique connecting arms 223 arranged alternately to connect adjacent ends of adjacent folded parts 221 in the longitudinal direction. The contact portion 23 is of long plate shape and extends frontward from the distal end of the elastic portion 22. The soldering portion 24 is of plate shape and extends rearward from the holding portion 21. The two rows of the U-shaped folded parts 221 are bent a same side to make the elastic portion 22 showing a substantially U shape seen in the longitudinal direction. The contact portion 23 is folded back towards the same side as the folded parts 221. The soldering portion 24 is folded back towards the same side as the folded parts 221 and then extending parallel with the holding portion 21.

Referring to FIGS. 1-3, the plurality of conducting pieces 30 are assembled into the inserting grooves 14 of the insulating body 10 and contact with the respective electrical terminals 20. Each of the conducting pieces 30 has a base plate 31. A middle of the base plate 31 is punched to form a projection plate 32. Each of the conducting pieces 30 has a length substantially equal with a total length of the holding portion 21 and the elastic portion 22 in the longitudinal direction. The projection plate 32 extends along a length direction of the conducting piece 30. Each of the conducting pieces 30 is a high-conductive copper.

Referring to FIG. 1-3, the fastening terminal 40 is used to fix the battery connector 100 to the circuit board 50. The fastening terminal 40 has a vertical blocking plate 41 and a horizontal holding plate 42.

Referring to FIG. 1-5, the electrical terminals 20 are assembled in the terminal grooves 13. The holding portion 21 is assembled in a rear portion of the receiving groove 131. The contact portion 23 passes through the through groove 132 and protrudes beyond the front of the insulating body 10. The folded parts 221 of the elastic portion 22 are received in the side grooves 133. The transverse connecting arms 222 and the oblique connecting arms 223 of the elastic portion 22 are received in the flat receiving groove 131. The soldering portion 24 is located in through groove 132. A bottom face of the soldering portion 24 and a bottom face of the soldering table 11 are coplanar. The plurality of conducting pieces 30 are inserted into the inserting grooves 14 and contact with the respective electrical terminals 20. The base plate 31 is received in the wide groove 141 and the projection plate 32 is received in the narrow groove 142. The projection plate 32 contacts the holding portion 21 and the connecting arms 222, 223 of the elastic portion 22. When the mobile phone is used, the current from the battery is transmitted to the contact portions 23 and then passes through the elastic portions 22, the holding portions 21 and the conducting pieces 30 and finally is transmitted to the circuit board 50 through the soldering portions 24. Because part of the current passes through the conducting pieces 30, heat generated by the electrical terminals 20 is reduced to ensure that the temperature of the battery connector 100 and the mobile phone is within the normal range. The fastening terminals 40 are assembled in the fastening grooves 121. The blocking plate 41 is assembled in the fastening groove 121. The holding plate 42 and the fixing table 12 are coplanar. The circuit board 50 is assembled to the bottom faces of the soldering table 11 and the fixing table 12 in order to reduce the height of the mobile phone. The soldering portion 24 and the holding plate 42 are soldered on the circuit board 50.

As described above, the conducting pieces 30 contact with the electrical terminals 20. When the mobile phone is used, part of the current passes through the conducting pieces 30, heat generated by the electrical terminals 20 is reduced to ensure that the temperature of the battery connector 100 and the mobile phone is within the normal range.

What is claimed is:

1. A battery connector with large current carrying capacity, comprising:

an insulating body defining a plurality of terminal grooves penetrating through a front and a rear thereof and a plurality of inserting grooves communicating with the respective terminal grooves;

a plurality of electrical terminals assembled into the terminal grooves of the insulting body; and a plurality of conducting pieces assembled into the inserting grooves of the insulating body and contacting with the electrical terminals;

wherein each of the electrical terminals includes a holding portion of a plate shape, an elastic portion connected with one end of the holding portion, a contact portion connected with a distal end of the elastic portion and utilized to contact a battery, and a soldering portion connected with the other end of the holding portion and soldered on a circuit board, each of the conducting pieces contacts with the holding portion and the elastic portion;

wherein each of the conducting pieces has a length substantially equal with a total length of the holding portion and the elastic portion in a longitudinal direction;

wherein the elastic portion is repeatedly folded along the right-left direction and extends in a longitudinal direction;

wherein each of the inserting grooves shows a substantially "凸" shape and includes a wide groove and a narrow groove, the narrow groove communicates with the corresponding receiving groove, each of the conducting pieces has a base plate inserted in the wide groove, a middle of the base plate is punched to form a projection plate inserted in the narrow groove, the projection plate contacts with the corresponding electrical terminal.

2. The battery connector with large current carrying capacity as claimed in claim 1, wherein each of the electrical terminals includes a holding portion of a plate shape, an elastic portion connected with one end of the holding portion, a contact portion connected with a distal end of the elastic portion, and a soldering portion connected with the other end of the holding portion, the projection plate contacts with the holding portion and the elastic portion.

3. The battery connector with large current carrying capacity as claimed in claim 2, wherein each of the conducting pieces has a length substantially equal with a total length of the holding portion and the elastic portion in a longitudinal direction, the projection plate extends along a length direction of the conducting piece.

4. The battery connector with large current carrying capacity as claimed in claim 2, wherein the elastic portion is repeatedly folded along the right-left direction and extends in a longitudinal direction.

5. The battery connector with large current carrying capacity as claimed in claim 1, wherein the elastic portion includes a plurality of U-shaped folded parts formed in two rows in two sides thereof and a plurality of connecting arms connecting the U-shaped folded parts, the two rows of the U-shaped folded parts are bent a same side to make the elastic portion show a substantially U shape seen in the longitudinal direction, the projection plate contacts with the connecting arms and opposite to the U-shaped folded parts.

6. The battery connector with large current carrying capacity as claimed in claim 5, wherein the contact portion is punched to a long plate shape and extends frontward from the distal end of the elastic portion and is folded back towards the same side as the U-shaped folded parts, the soldering portion is punched to a plate shape and extends rearward from the holding portion and is folded back towards the same side as the U-shaped folded parts and then extending parallel with the holding portion.

7. The battery connector with large current carrying capacity as claimed in claim 1, wherein the insulating body has a base body, an upper portion of a rear face of the base body protrudes rearward to form a soldering table, the terminal grooves and the inserting grooves penetrate through the soldering table, the inserting grooves are disposed over the respective terminal grooves.

8. The battery connector with large current carrying capacity as claimed in claim 1, wherein each of the conducting pieces is a high-conductive copper.

* * * * *